US007438214B2

(12) United States Patent
Riker et al.

(10) Patent No.: US 7,438,214 B2
(45) **Date of Patent: *Oct. 21, 2008**

(54) MAILBOX POST BRACKET

(75) Inventors: Ronald D. Riker, Brownwood, TX (US); Darrell W. Heald, Georgetown, TX (US)

(73) Assignee: Caminoverde II, L.L.P., Hutto, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/676,155

(22) Filed: Feb. 16, 2007

(65) Prior Publication Data

US 2007/0152031 A1 Jul. 5, 2007

Related U.S. Application Data

(63) Continuation-in-part of application No. 10/735,360, filed on Dec. 12, 2003, now Pat. No. 7,178,772.

(51) Int. Cl.
*A47G 29/12* (2006.01)

(52) U.S. Cl. ..... 232/39; 248/219.2; 248/146

(58) Field of Classification Search ..... 232/39; D99/32; 248/219.2, 219.4, 146, 220.21, 248/152, 158

See application file for complete search history.

(56) References Cited

U.S. PATENT DOCUMENTS 1,602,290 A 10/1926 Taylor
2,440,576 A * 4/1948 De Haas ..... 248/218.4
2,552,915 A 5/1951 Zachrich
3,802,656 A 4/1974 Virblas
4,236,665 A 12/1980 Glass
4,286,747 A 9/1981 Deike
4,300,739 A 11/1981 Sande
4,403,730 A 9/1983 Batson
4,951,905 A 8/1990 Bronson et al.
5,065,975 A 11/1991 Giles
D350,003 S 8/1994 Rentz
5,337,954 A 8/1994 Kobilarcik et al.
5,386,938 A 2/1995 West
5,509,603 A 4/1996 Hering
5,664,748 A 9/1997 Speece et al.
6,047,933 A 4/2000 Hoover

* cited by examiner

*Primary Examiner*—William L. Miller
(74) *Attorney, Agent, or Firm*—Storm LLP; Mark D. Perdue

(57) ABSTRACT

A mailbox bracket comprises a laminar plate that is generally coextensive with a lower surface of the mailbox and has a pair of flanges for securing the mailbox to the plate. A generally cylindrical sleeve is secured to the plate and extends downwardly therefrom. The sleeve is adapted to receive a generally cylindrical post and includes an aperture for use with a bolt or pin to secure the post within the sleeve. According to one embodiment of the invention, the bracket is formed of steel. According to another embodiment of the invention, the bracket is integrally formed of nylon polymer and includes a plurality of strengthening ribs extending radially outward from the sleeve.

19 Claims, 5 Drawing Sheets

MAILBOX POST BRACKET

REFERENCE TO RELATED APPLICATIONS

This application is a continuation-in-part of U.S. application Ser. No. 10/735,360, filed Dec. 12, 2003, now U.S. Pat. No. 7,178,722.

BACKGROUND OF THE INVENTION

Field of the Invention

The present invention relates generally to mailboxes for use adjacent roadways. More particularly, the present invention relates to the bracket used to secure a conventional mailbox to the post on which it is mounted.

SUMMARY OF THE PRIOR ART

For decades, the mailbox has been a familiar sight along the roadways of America, particularly along rural roads and highways. Because these mailboxes are typically arranged only a few feet from the edge of the roadway, highway authorities often prescribe regulations dealing with the construction of such mailboxes. The design of the mailbox itself is prescribed by the postal authorities, i.e. the United States Postal Service (USPS).

Due to their location adjacent roadways, mailboxes and other roadside features often are struck in roadway accidents, making their construction to be "crash worthy" an issue of some importance. The National Cooperative Highway Research Program has promulgated standards for the safety evaluation of highway features such as signs and sign supports in Report 350. The standards set forth in Report 350 relate to the behavior of highway features when struck by a vehicle. The desired behavior is that the sign or other feature fails in such a way that property damage and personal injury are minimized to the extent possible. Thus, the terms "crashworthiness" and "crash worthy," as used herein, actually mean susceptibility to failure in the event of a crash or collision, rather than resistance to failure. The standards and testing methodologies contained in Report 350 have been adopted by most states. Therefore, the majority of roadside signs and features are made in consideration of, if not in compliance with, the standards of Report 350.

Consistent with this concern over the construction of roadside features, it is typical for a mail customer who intends to place a mailbox by the roadside to apply to the local office of the highway regulation authority for permission to place the box. In some states, the authorities themselves provide the post and install a USPS-approved mailbox on an approved, crash worthy post in what the authorities deem a safe location and in a safe fashion.

The conventional mailbox and post assembly, including the bracket, when struck by a vehicle, sometimes exhibits a mode of failure in which the mailbox detaches from the post and can come through the windshield of the vehicle, thereby posing a grave risk to the occupants of the vehicle in what otherwise might be a relatively minor accident.

A need exists for both posts and brackets for securing the mailbox to the post that are easily and inexpensively manufactured and fail in a relatively safe or crash worthy mode in the event of an accident.

SUMMARY OF THE INVENTION

It is a general object of the present invention to provide an improved bracket for securing a mailbox to a support post that is circular in cross-section.

This and other objects of the present invention are achieved by providing a bracket comprising a laminar plate that is generally coextensive with a lower surface of the mailbox and has means for securing the mailbox to the plate. A generally cylindrical sleeve is secured to the plate and extends downwardly therefrom. The sleeve is adapted to receive a generally cylindrical post and includes means for securing the post within the sleeve.

According to the preferred embodiment of the present invention, the laminar plate is rectangular and has a pair of long edges.

According to the preferred embodiment of the present invention, the means for securing the mailbox to the plate further comprises a flange on each of the long edges of the plate extending generally perpendicular to the plate and at least one fastener securing the flange to a corresponding flange on the mailbox. The fastener may be a nut and a bolt.

According to the preferred embodiment of the present invention, the means for securing the post within the sleeve further comprises an aperture formed through the sleeve and the post and a bolt extending through the aperture, thereby securing the sleeve against movement relative to the post.

According to the preferred embodiment of the present invention, the plate is provided with a plurality of lightening holes.

According to another preferred embodiment of the present invention, the bracket is integrally formed of injection-molded polymer.

According to another preferred embodiment of the present invention, a plurality, preferably ten, strengthening ribs extend radially from the sleeve.

DETAILED DESCRIPTION OF THE INVENTION

Figure 1:
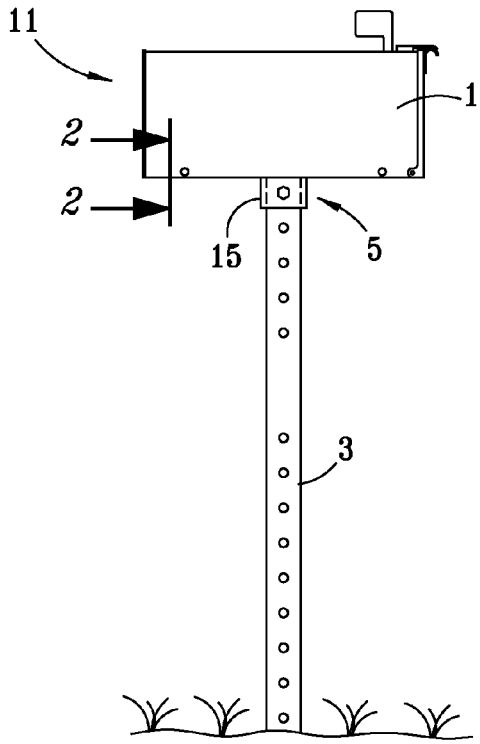
FIG. 1 (PRIOR ART)
FIG. 1 is an elevation view of a mailbox of the type with which the present invention is contemplated for use, illustrating a prior-art post and bracket.
Figure 2:
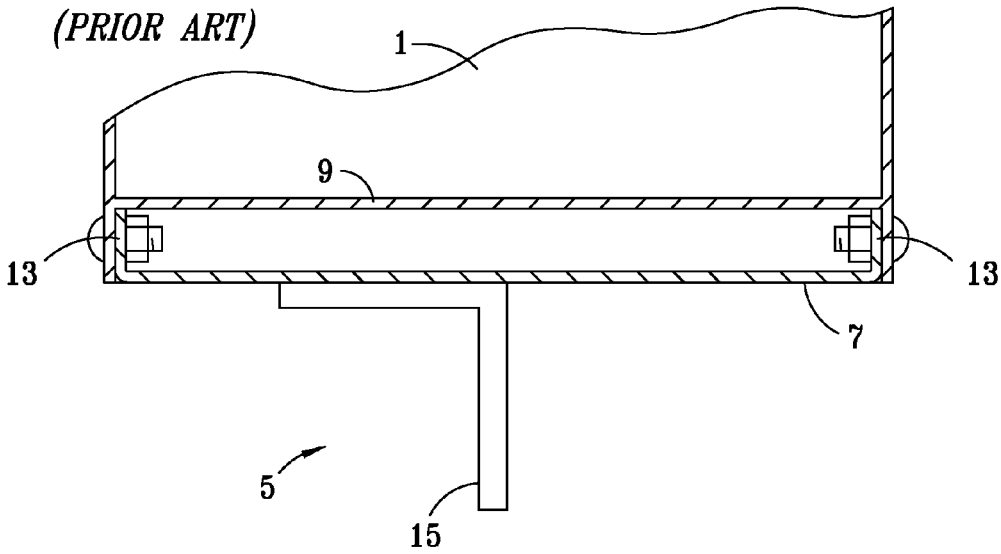
FIG. 2 (PRIOR ART)
FIG. 2 is a partial section view, taken along section line 2-2 of FIG. 1, illustrating the prior-art bracket.

Referring now to the Figures, and particularly to FIGS. 1 and 2, a prior-art mailbox assembly 11 is illustrated. The assembly comprises a mailbox 1, which is commonly available and made to USPS standards. Mailbox 1 is secured atop a post 3, which conventionally is provided by the highway regulation authorities. In this case, post 3 that is illustrated is formed of steel and has a plurality of holes along its length. Mailbox 1 is secured atop post 1 by means of a bracket 5, which is illustrated in greater detail in FIG. 2.

Bracket 5 has a generally flat, rectangular plate 7 that is generally coextensive with bottom 9 of mailbox 1. Plate 7 has a pair of upwardly extending flanges 13 along its long edges. Flanges 13 mate with corresponding downwardly turned flanges on mailbox 1, and nuts, screws, or rivets are used to secure the two together. A steel L-shaped bracket 15 is secured, typically by bolts, to the bottom of plate 7 and extends downwardly to permit bracket 5 and mailbox 1 to be secured by bolts to post 3. This bracket is satisfactory in most respects, except that it has been observed that a fairly typical failure mode for this design, in the event of a collision with a vehicle, is for mailbox 1 to shear off of bracket 5 in a plane parallel to plate 7 and bottom 9 of mailbox 1. When this occurs, mailbox 1 then is free to come through the windshield of the vehicle, with potentially fatal consequences for the vehicle's occupants.

Figure 3:
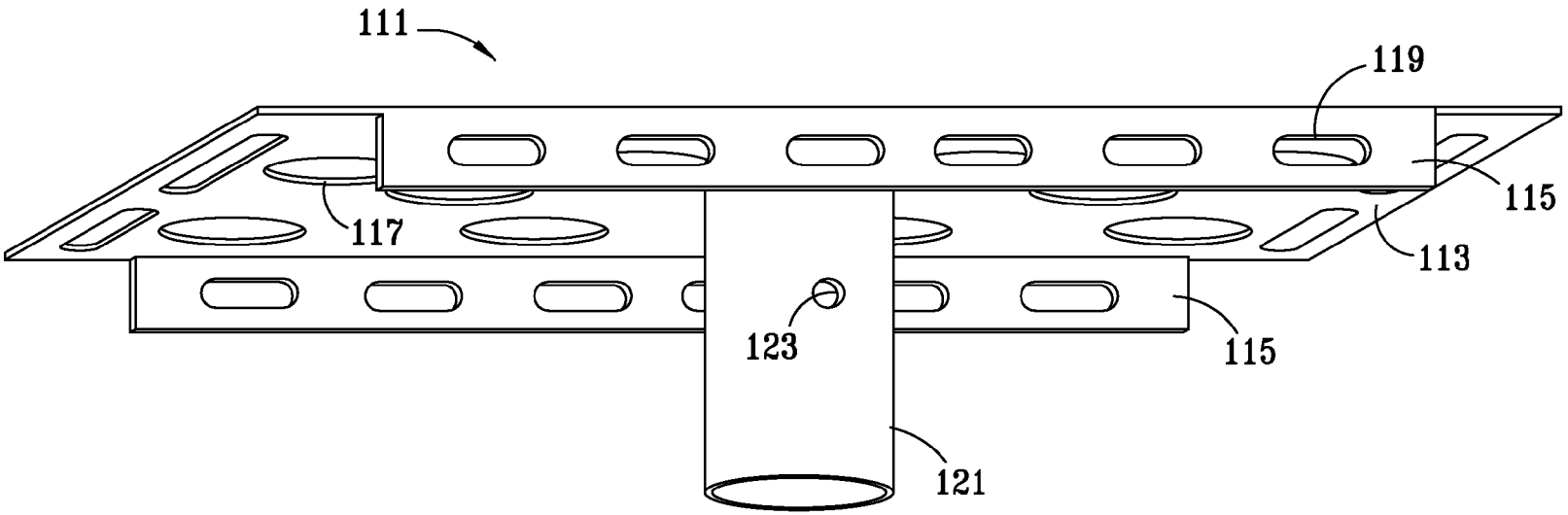
FIG. 3 is a perspective view of the mailbox bracket according to the present invention.
Figure 4:
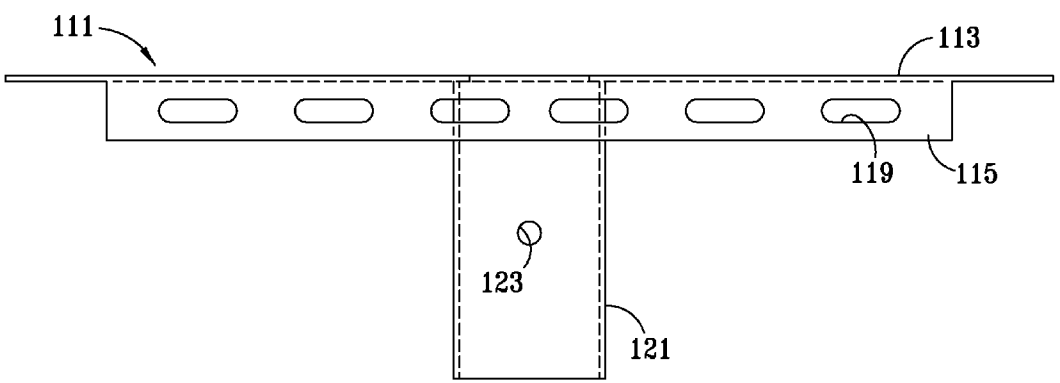
FIG. 4 is a plan view of the mailbox bracket of FIG. 3.
Figure 5:
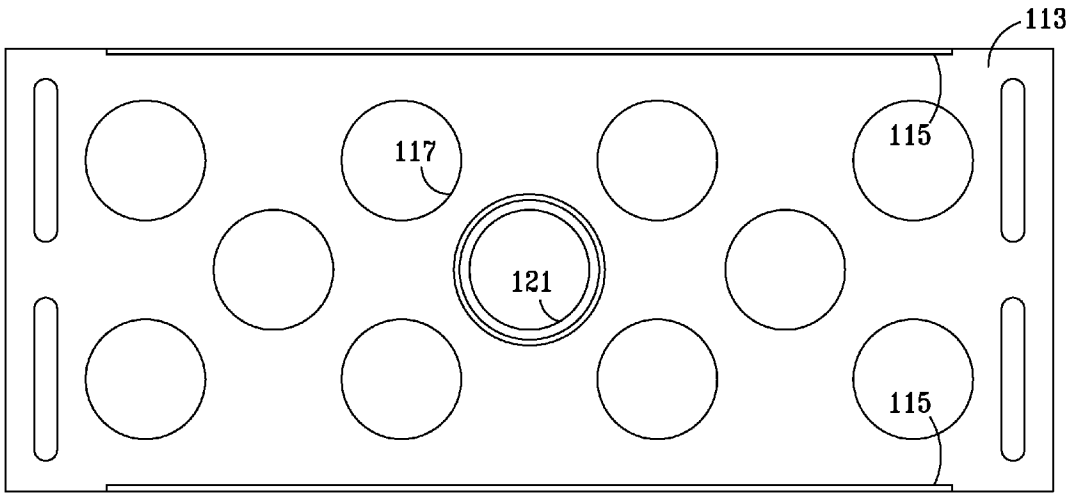
FIG. 5 is an elevation view of the mailbox bracket of FIGS. 3 and 4.

FIGS. 3, 4, and 5 are various views of mailbox bracket 111 according to the preferred embodiment of the present invention. This embodiment, as tested, seems to avoid the failure mode described above and is also adapted to receive a cylindrical (circular in cross section) post as described in commonly invented U.S. Pat. No. 7,179,016, which is more aesthetically pleasing than the conventional post shown in FIG. 1. As shown, bracket 111 comprises a rectangular, generally laminar plate 113, which is generally coextensive with the bottom surface of mailbox 1 (it is not necessary that plate 113 be as long as mailbox, but must be as wide).

A pair of downwardly extending flanges 115 is formed on the long edges of plate 113 and is provided with a plurality of oblong holes 119 to facilitate mounting to the corresponding downwardly turned flanges on mailbox 1 by bolts (see FIG. 2). A plurality of lightening holes or apertures 117 are formed through plate 113 to save material and reduce the overall weight of bracket 115. A cylindrical sleeve 121 is secured to a central portion of plate 113 (approximately equidistant from each edge or side of the plate) and extends downwardly therefrom in the same direction as flanges 115. As illustrated, sleeve 121 is of single or one-piece construction and is therefore continuous.

Sleeve 121 thus forms a socket adapted to receive a cylindrical post. An aperture 123 is provided in the wall of sleeve 121 and extends through both walls of sleeve 121. A corresponding aperture or hole in a post thus can be aligned with aperture 123 and a bolt or cotter pin (not shown) used to secure mailbox 1 and bracket 111 to the post and against rotation relative to the post.

According to the preferred embodiment of the present invention, plate 113 is formed from a sheet of 0.074 inch 14-gauge type A36 mild steel 121. Sleeve 121 preferably is formed of 2.5 inch O.D. by 0.065 inch wall thickness 1020 steel and is wire welded to plate 113 in a conventional manner. These dimensions are given for a post having a nominal outer diameter of 2.5 inches. Dimensions will, of course, vary with the application.

Figure 6:
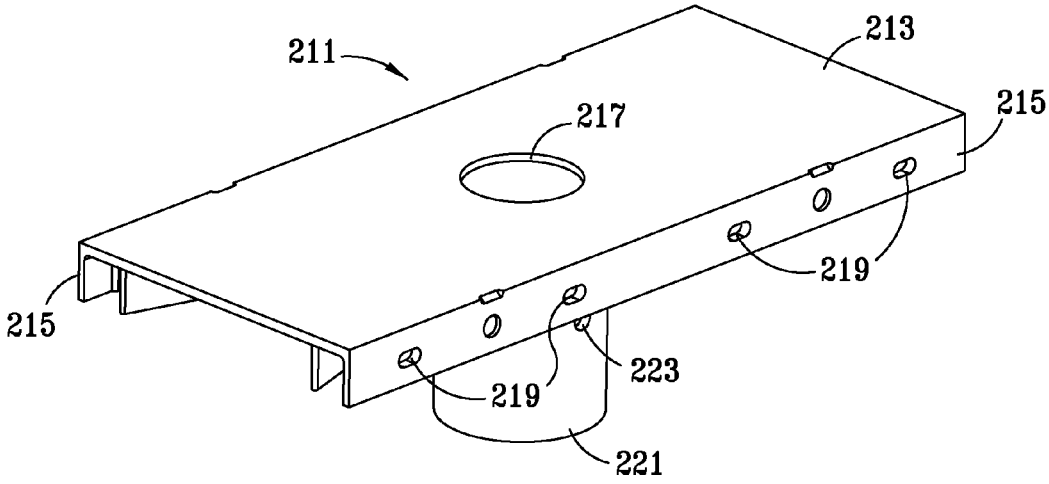
FIG. 6 is a top perspective view of an embodiment of the present invention formed of injection-molded polymer.
Figure 7:
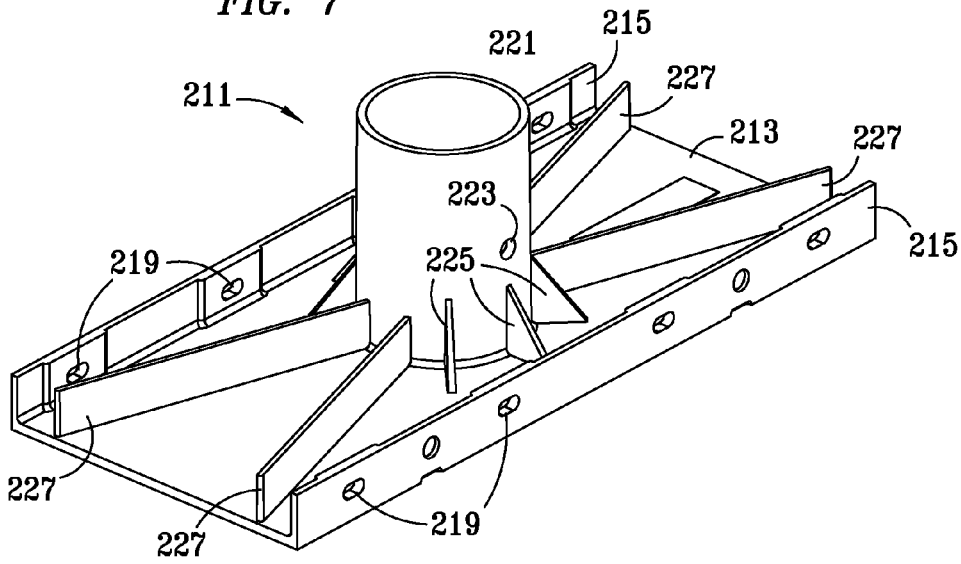
FIG. 7 is a bottom perspective view of the embodiment of the present invention of FIG. 6.
Figure 8:
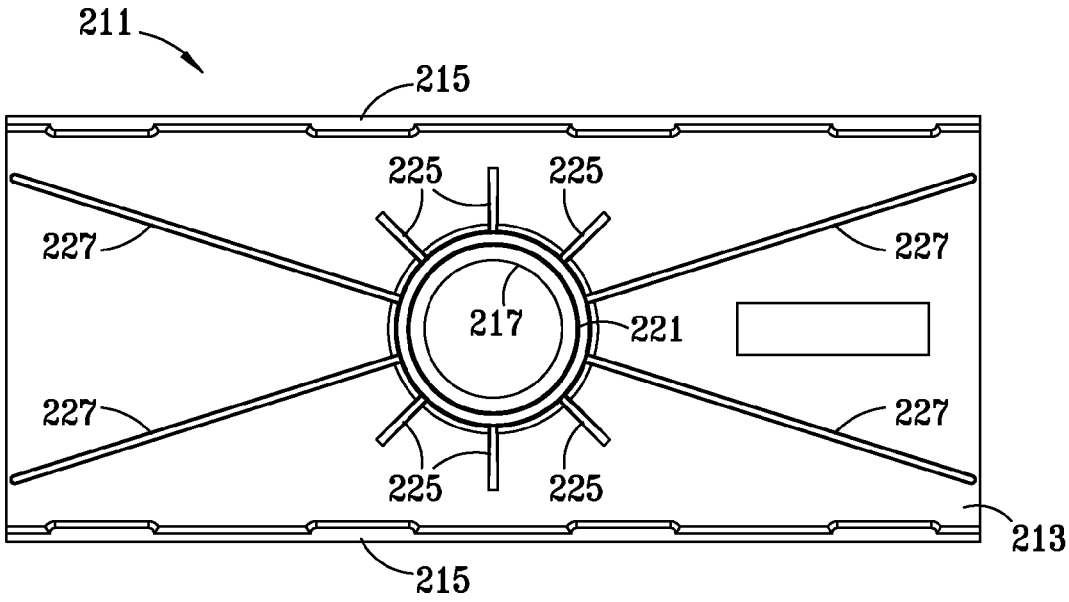
FIG. 8 is a bottom plan view of the embodiment of the present invention of FIGS. 6 and 7.

FIGS. 6, 7, and 8 illustrate a mailbox bracket 211 according to the present invention that is a single piece integrally formed of injection-molded polymer, preferably Nylon 66 sold under the brand name Nyloy MS-0100B by Shanghai Nytex Composite Products Co. Ltd. of Shanghai, China. This material is lighter and cheaper than the steel of the embodiment of FIGS. 2 through 5, yet retains the crash properties of the steel embodiment.

As is shown, polymer bracket 211 is of generally similar configuration to the steel embodiment, having a plate 213 and downwardly turned flanges 215. Plate 213 and flanges 215 have a wall thickness of approximately 0.175 inch. Mounting apertures or holes 219 are provided in each flange 215 and are oval in configuration to accommodate misalignment between holes 219 and corresponding holes in the flanges on the mailbox itself. The material of flange 215 surrounding each hole 219 is 0.075 inch thicker (shown in FIG. 8) than the surrounding material to strengthen the structure around each hole 219. A one-piece, generally cylindrical and continuous sleeve 221 depends downwardly from plate 213 in a central portion that is equidistant from each edge of the plate. Sleeve 221 has a wall thickness of approximately 0.145 inch. A fastening aperture 223 is provided. .There is no need for the lightening holes used in the steel embodiment, although a circular aperture 217 is formed in plate 213 coaxially with sleeve 221.

Because the polymer material is not as strong as the steel of the embodiment of FIGS. 2 through 5, a plurality of (ten) reinforcing webs 225, 227 extend radially from the exterior of sleeve 221 and intersect the underside of plate 213. Preferably, there are six shorter triangular webs 225 that extend toward flanges 215 on each side of sleeve 221. Four longer, generally rectangular webs 227 extend from sleeve 221 to the forward and rear edges of plate 213. These webs provide sufficient rigidity to the structure to permit it to be made of the polymer material.

In operation, mailbox 1 is placed atop plate 113, 213 and holes 119, 219 in flanges 115, 215 are aligned with corresponding holes (not shown) in the flanges (FIG. 1) on mailbox 1. According to the preferred embodiment, bottom 9 of mailbox 1 then is in close proximity to plate 113, 213. Bracket 111, 211 and sleeve 121, 221 are placed atop a cylindrical post and a bolt or pin used to secure them together. Testing indicates that the bracket as described herein avoids the potentially troublesome failure mode described above. It is also adapted to be used with a more aesthetically pleasing cylindrical post.

The invention has been described with reference to a preferred embodiment. It is thus not limited, but is susceptible to variation and modification without departing from the scope of the invention.

We claim:

1. A bracket for securing a mailbox to an upstanding post that is generally cylindrical in cross-section, the bracket comprising:

a rectangular plate having an upper surface and a lower surface and a pair of long edges, the upper surface of the plate being dimensioned to be generally coextensive with and to support a lower surface of the mailbox;

a flange on each long edge of the plate, the flange extending generally perpendicular to and downwardly from the lower surface of the plate;

at least one fastening aperture formed in the flange;

a continuous and generally cylindrical sleeve secured to a central portion of the lower surface of the plate and extending downwardly therefrom, the sleeve adapted to receive the generally cylindrical post; and a sleeve aperture formed in the sleeve.

2. The bracket according to claim 1 further comprising:

a post aperture formed through the post; and a bolt extending through the post and sleeve apertures, thereby securing the sleeve against movement relative to the post.

3. The bracket according to claim 1 wherein the fastening aperture aligns with a corresponding aperture on a corresponding flange on the mailbox and a fastener is inserted through both apertures to secure the mailbox to the bracket.

4. The bracket according to claim 1 wherein the plate is provided with a plurality of lightening holes.

5. The bracket according to claim 1 wherein the bracket is integrally formed of a single piece of injection-molded polymer.

6. The bracket according to claim 5, wherein the polymer is nylon.

7. The bracket according to claim 5, further comprising:

a plurality of reinforcing webs extending radially outward from the sleeve, each reinforcing web intersecting the plate and the sleeve.

8. A bracket for securing a mailbox to an upstanding generally cylindrical post, the bracket comprising:

a rectangular plate having an upper surface and a lower surface and a pair of long edges and a pair of short edges, the upper surface of the plate being dimensioned to be generally coextensive with and to support a lower surface of the mailbox;

a flange extending along each long edge of the plate generally perpendicular to and downwardly from the lower surface of the plate;

at least one fastener for securing the flanges to corresponding flanges on the mailbox;

a generally cylindrical sleeve formed of a single piece and secured to the lower surface of the plate and extending downwardly therefrom, the sleeve adapted to receive the generally cylindrical post; and a sleeve fastener for securing the post within the sleeve.

9. The bracket according to claim 8 wherein the sleeve fastener further comprises:

an aperture formed through the sleeve and the post; and a bolt extending through the aperture, thereby securing the sleeve against movement relative to the post.

10. The bracket according to claim 8 wherein the fastener is a nut and a bolt.

11. The bracket according to claim 8 wherein the bracket is integrally formed of a single piece of injection-molded polymer.

12. The bracket according to claim 11, wherein the polymer is nylon.

13. The bracket according to claim 11, further comprising:

a plurality of reinforcing webs extending radially outward from the sleeve, each reinforcing web intersecting the plate and the sleeve.

14. A bracket for securing a mailbox to an upstanding, generally cylindrical post, the bracket comprising:

a rectangular plate formed of a polymer, the plate having an upper surface and a lower surface and a pair of long edges and a pair of short edges, the upper surface of the plate being dimensioned to be generally coextensive with and to support a lower surface of the mailbox;

a flange extending along each long edge of the plate generally perpendicular to and downwardly from the lower surface of the plate, each flange being integrally formed with the plate;

at least one fastener for securing the flanges to corresponding flanges on the mailbox;

a generally cylindrical sleeve secured to lower surface of the plate and extending downwardly therefrom, the sleeve adapted to receive the generally cylindrical post, the sleeve being integrally formed with the plate; and a sleeve fastener for securing the post within the sleeve.

15. The bracket according to claim 14 wherein the sleeve fastener further comprises:

an aperture formed through the sleeve and the post; and a bolt extending through the aperture, thereby securing the sleeve against movement relative to the post.

16. The bracket according to claim 14 wherein the fastener is a nut and a bolt.

17. The bracket according to claim 14 wherein the bracket is integrally formed of a single piece of injection-molded polymer.

18. The bracket according to claim 17, further comprising:

a plurality of reinforcing webs extending radially outward from the sleeve, each reinforcing web intersecting the plate and the sleeve.

19. The bracket according to claim 14, wherein the polymer is nylon.

* * * * *